US006799638B2

(12) United States Patent
Butterfield, Jr.

(10) Patent No.: US 6,799,638 B2
(45) Date of Patent: Oct. 5, 2004

(54) METHOD, APPARATUS AND SYSTEM FOR SELECTIVE RELEASE OF CEMENTING PLUGS

(75) Inventor: Charles A. Butterfield, Jr., Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 131 days.

(21) Appl. No.: 10/087,513

(22) Filed: Mar. 1, 2002

(65) Prior Publication Data

US 2003/0164237 A1 Sep. 4, 2003

(51) Int. Cl.[7] ..... E21B 33/08; E21B 33/13

(52) U.S. Cl. ..... 166/386; 166/75.15; 166/177.3; 166/188; 166/373

(58) Field of Search ..... 166/373, 381, 166/383, 386, 387, 75.15, 179, 181, 188, 191–194, 202, 177.3, 325, 318

(56) References Cited

U.S. PATENT DOCUMENTS

| | | | | | |
|---|---|---|---|---|---|
| 2,471,383 | A | | 5/1949 | Althouse, Jr. et al. | 166/1 |
| 3,545,542 | A | * | 12/1970 | Scott | 166/155 |
| 3,730,267 | A | | 5/1973 | Scott | 166/0.5 |
| 3,796,260 | A | * | 3/1974 | Bradley | 166/153 |
| 4,042,014 | A | * | 8/1977 | Scott | 166/367 |
| 4,164,980 | A | | 8/1979 | Duke | 166/291 |
| 4,246,967 | A | * | 1/1981 | Harris | 166/291 |
| 4,436,151 | A | * | 3/1984 | Callihan et al. | 166/154 |
| 4,442,894 | A | * | 4/1984 | Callihan et al. | 166/156 |
| 4,624,312 | A | | 11/1986 | McMullin | 166/15 |
| 4,671,358 | A | * | 6/1987 | Lindsey et al. | 166/291 |
| 4,809,776 | A | | 3/1989 | Bradley | 166/153 |
| 4,823,882 | A | | 4/1989 | Stokley et al. | 166/387 |
| 4,862,966 | A | | 9/1989 | Lindsey et al. | 166/382 |
| 5,181,569 | A | | 1/1993 | McCoy et al. | 166/317 |
| 5,236,035 | A | | 8/1993 | Brisco et al. | 166/70 |
| 5,271,468 | A | * | 12/1993 | Streich et al. | 166/387 |

(List continued on next page.)

FOREIGN PATENT DOCUMENTS

| | | | |
|---|---|---|---|
| WO | WO 94/27026 | 11/1994 | E21B/33/16 |
| WO | WO 00/66879 | 11/2000 | E21B/33/16 |

OTHER PUBLICATIONS

Article entitled "Drilling Technology, System Fills Casing Annulus During Lowering Operation" by William Furlow—Offshore—May 1998.

(List continued on next page.)

*Primary Examiner*—David Bagnell
*Assistant Examiner*—Jennifer Gay
(74) *Attorney, Agent, or Firm*—Craig W. Roddy; John W. Wustenberg; Carlos A. Torres

(57) ABSTRACT

A running tool for wiper plugs used in cementing well casings into a wellbore. The running tool and setting balls or darts used to launch the plugs are retrievable following deployment of the plugs. Flapper valve assemblies on the wiper plugs are activated after the plugs are displaced from the running tool to eliminate the requirement to maintain a setting ball or dart in engagement with the wiper plug as the assembly is pumped down the well casing. Because of being retrievable, the mandrel, setting sleeves and setting ball or dart may be constructed of any desirable high-strength material without regard to the need to drill up the material following completion of the cementing job. The use of high-strength steel permits large flow passages to be employed in the cementing plugs by eliminating the need for large volumes of drillable metals in the plugs. The running tool protects the flapper valve seal surfaces from circulating fluids prior to deployment of the plugs from the tool.

40 Claims, 5 Drawing Sheets

U.S. PATENT DOCUMENTS

| | | | | | |
|---|---|---|---|---|---|
| 5,435,390 | A | | 7/1995 | Baugh et al. | 166/285 |
| 5,443,122 | A | * | 8/1995 | Brisco | 166/285 |
| 5,522,458 | A | * | 6/1996 | Watson et al. | 166/202 |
| 5,722,491 | A | | 3/1998 | Sullaway et al. | 166/291 |
| 5,738,171 | A | * | 4/1998 | Szarka | 166/289 |
| 5,762,139 | A | | 6/1998 | Sullaway et al. | 166/291 |
| 5,829,523 | A | | 11/1998 | North | 166/250.14 |
| 5,833,002 | A | | 11/1998 | Holcombe | 166/291 |
| 5,918,673 | A | | 7/1999 | Hawkins et al. | 166/285 |
| 6,050,336 | A | | 4/2000 | Willauer et al. | 166/286 |
| 6,196,311 | B1 | | 3/2001 | Treece | 166/192 |
| 6,302,199 | B1 | | 10/2001 | Hawkins et al. | 166/70 |
| 6,513,590 | B2 | * | 2/2003 | Allamon et al. | 166/181 |
| 6,571,880 | B1 | * | 6/2003 | Butterfield et al. | 166/386 |

OTHER PUBLICATIONS

Product Catalog: Nodeco, A Weatherford Co. Wiper Plugs, 3 pages Dated May 21, 1999.

Halliburton brochure entitled "FACTS™ Fill–up and Cementing Tool System" dated Dec. 1999.

* cited by examiner

METHOD, APPARATUS AND SYSTEM FOR SELECTIVE RELEASE OF CEMENTING PLUGS

FIELD OF THE INVENTION

The present invention relates to cementing pipe within a wellbore. More particularly, the present invention relates to selectively releasing wiper plugs contained within enclosed launching assemblies for cementing casing, subsea casing strings and casing liners in wells.

BACKGROUND OF THE INVENTION

Pipe used to case wellbores is cemented into the wellbore to anchor the well pipe and isolate differently pressured zones penetrated by the wellbore. Pipe used for this purpose is generally referred to as "casing." The cementing step is initiated by pumping a cement slurry down into the casing from the well surface. The cement slurry flows out from the bottom of the casing and returns upwardly toward the surface in the annulus formed between the casing and the surrounding wellbore.

In the cementing process, the fluid normally used in the drilling of the wellbore, referred to herein generally as "drilling fluid," is displaced from the casing ahead of the cement slurry pumped into the casing. When a sufficient volume of the cement slurry has been pumped into the well pipe, drilling fluid is used to displace the cement from the well pipe to prevent the pipe from being obstructed by the cured cement.

The drilling fluid and cement slurry are separated during the displacements with appropriate liquid spacers, or more preferably, with sliding wiper plugs that seal along the inside of the well pipe, wiping the inside of the pipe and isolating the cement slurry from the drilling fluid. When using wiper plugs to separate the drilling fluid and cement, the cement slurry is pumped behind a first wiper plug to push the plug through the casing, forcing the drilling fluid in the casing to flow ahead of the plug. The drilling fluid displaced from the bottom of the casing flows upwardly through the annulus and returns toward the well surface.

When a sufficient volume of cement has been pumped behind the first wiper plug, a second wiper plug is positioned in the casing and drilling fluid is pumped into the casing behind the second plug to push the cement slurry through the casing. A flow passage in the first plug opens when it reaches the casing bottom to permit the cement slurry to flow through and past the plug, out the casing bottom. Once the first wiper seal has been opened and its seal terminated, the continued advance of the second plug through the casing displaces the cement slurry past the first plug, around the end of the casing, and up into the annulus. The second plug stops and maintains its sealing engagement with the casing once it arrives at the bottom of the casing.

When the casing string extends back to the drilling rig, the first and second plugs and cement are manually inserted into the casing at the drilling rig floor. Remotely set plugs are used when the well casing that is to be cemented does not extend back to the drilling rig floor. For example, a "liner," which is a string of casing that hangs from the bottom of a previously installed larger diameter section of casing, does not extend back to the drilling rig floor. Subsea completions in offshore wells also involve strings of casing that do not extend back to the drilling rig.

Installing and cementing strings of casing that do not extend to the drilling rig is typically done by installing the casing string with a smaller diameter running string. If wiper plugs are employed in this process, they are carried on a running tool at the lower end of a small diameter string of drill pipe that extends from the drilling rig and connects to the top of the larger diameter casing string that is to be cemented. The drilling fluid and the cement slurry required to perform the cementing operation are initially pumped from the surface through the small diameter drill pipe, through circulating openings in the wiper plugs and into the casing. The plugs are "remotely set" from the rig floor using setting devices that are inserted into the string at the rig floor and pumped down to the plugs carried on the running tool. The cement slurry exiting the bottom of the casing string returns in the annulus to the point at which the casing string is hung off from the higher casing string or sub sea wellhead.

In a typical operation of remotely set wiper plugs carried at the end of a running tool on a drill string, a brass ball, or a weighted plastic ball or dart or other setting device is inserted into the drill string at the surface ahead of the cement slurry. The ball passes through the opening in the upper wiper plug and lands in and closes a smaller circulation opening in the lower plug. The resulting pressure increase releases the lower plug for movement through the casing. When sufficient cement has been pumped into the drill string and casing from the surface, a latch-down plug or seal dart is inserted into the drill string and pumped down to the upper wiper plug still secured to the running tool. Arrival of the latch-down plug at the upper plug closes the circulation opening and releases the upper plug for movement through the casing string. The upper plug is then pumped to the bottom of the casing to completely displace the cement slurry from the casing.

Remotely set wiper plugs are also employed in rig floor cementing assemblies that employ multipurpose tools that function as combination fillup tools and cementing tools. These combination tools, as described in U.S. Pat. No. 5,918,673, may include remotely releasable plugs in the surface operated assembly to eliminate the need for a separate plug container or other similar device at the rig floor for deploying the cementing plugs.

A common requirement of remotely set wiper plugs, including those used in the combination tool assembly, is the need for the plugs to accommodate circulation of fluids before they are released to travel through the casing string. The size of circulation openings is a major consideration in the design of the wiper plugs and their launching mechanisms.

In use, the materials and components of the wiper plug must withstand the pumping pressure differentials and the erosion experienced during different phases of the cementing procedure. Any sealing surface exposed to the flow of the cement slurry and drilling fluids is subject to erosion damage and possible failure, particularly when the seals are formed of plastic or other non-durable materials. Accordingly, substantial volumes of durable material are required in the construction of conventional wiper plug assemblies to meet the strength and erosion resistance requirements imposed on the assemblies before their release.

The increased strength and durability of the plugs are typically achieved at the expense of the size of the circulation openings through the plugs. Because of their relatively small circulation openings, remotely set wiper plugs carried in a combination tool or connected with the drill pipe can create a restricted flow passage for pumped fluids. These flow restrictions can increase the possibility of packing off and other problems and can limit pumping rates for the drilling fluids as well as the cement slurry.

The wiper plugs used in cementing must also be constructed of materials that may be easily drilled up or milled away at the end of the cementing operation. Because of this requirement, the use of high-strength metal is undesirable in the construction of the wiper plugs. The necessary strength and durability requirements are met in conventional wiper plugs by using larger volumes of soft metals and other easily removable materials. The required large volumes of material can require small passage openings that can contribute to the restriction of flow of fluids through the wiper plugs.

The requirement for relatively large volumes of soft structural metal or durable plastics within conventional, remotely actuated wiper plugs also renders the use of certain designs impractical within smaller internal diameter well casings. For example, in well casings having an internal diameter of 7" or less, the volume of materials required to provide the support and release functions of a plug with a conventional design limit the fluid bypass opening so that desired pumping rates cannot be effectively obtained. The limited bypass openings also increase the likelihood of packing off the bypass and prematurely launching the plug.

Conventional, multi-plug assemblies employed in remotely launched systems typically require different designs for each wiper plug that is to be deployed within the well casing. Each of the different designs includes a large volume of the special material required for the structural support, sealing and latch release functions of the plugs. The total cost of employing conventional plugs includes the cost of the disposable materials incorporated into the plug and the requirement for separately dimensioned and designed plugs for each of the wiper plugs employed in the multi-plug assembly.

Gravity deployed balls used to launch a wiper plug may present certain operational difficulties with remotely operated plug launching systems. In particular, the ball's position cannot be accurately determined as it falls through the drill string en route to the subsurface plug. The speed of travel of the ball through the drill pipe is affected by gravity and by the flow rate and viscosity of fluid being pumped through the drill string. The effect due to gravity can become particularly problematic when the drill pipe extends through non-vertical orientations common in directionally drilled wells.

An alternative to employing balls as the release activating mechanism for the plug is to employ pump-down darts that can be displaced through the drill pipe ahead of the well fluid or cement slurry being pumped down into the casing. The benefit of the dart release mechanism is that its position can be accurately determined by measuring the volume of fluid being pumped into the pipe behind the dart. The dart also functions as an effective wiping structure that cleans the internal surface of the drill pipe as it is being pumped down to the plug.

An additional benefit of pump-down darts is that the dart may be rapidly forced through the drill string and into position within the wiper plug deployment tool. By contrast, the time required for a ball to eventually reach the wiper plug system under the force of gravity assisted by cement or drilling fluid flow is unpredictable.

Remote cementing plug launching systems that can easily accommodate a ball are not necessarily capable of functioning with a pump-down dart because of the limited axial development of the launching system. When the system employs multiple plugs that are to be deployed from a single running tool, the axial spacing between the release mechanisms of the plugs can preclude the effective use of pump-down darts.

SUMMARY OF THE INVENTION

The present invention provides a cementing running tool with wiper plugs having large circulation openings that allow increased bypass flow of drilling fluids and cement slurries. The plugs are constructed using a minimal amount of material, which permits large circulation openings and also reduces the amount of material to be milled out at the completion of the cementing process. The running tool provides a central, thin-walled tubular mandrel and release sleeves constructed of high-strength steel that support the wiper plugs and protect them from erosion while they are attached to the tool.

A ball or dart may be used to release the wiper plugs from the mandrel. The steel mandrel and the ball or dart used to release the wiper plugs remain with the running tool, eliminating the problem of drilling up or milling those components. Easily drillable flapper valve closure devices carried on the wiper plugs close the circulation openings when the plugs are deployed from the running tool to eliminate the need for the releasing ball or dart to be sent to the bottom of the casing as is done in many prior art designs. The seal surfaces for the circulation openings are protected from erosion by the running tool. Multiple plugs run in series may be of similar design to reduce construction costs.

The system of the present invention employs high-strength steel in a relatively thin-walled mandrel and release mechanism of a retrievable running tool to support and subsequently deploy the cementing plug. The use of a retrievable thin-walled mandrel and release mechanism for supporting and providing the structure for release of the plug permits larger flow openings through the plug and, because the mandrel is reusable, reduces the total cost of employing the system.

An important feature of the present invention is the elimination of the use of a ball or dart that must remain in the wiper plug to act as the flow closure element for the deployed wiper plug. Because the ball and dart are retrieved with the mandrel, they may be constructed of any desired material without regard to their drillability. Moreover, retrieval of the ball or dart allows them to be reused to reduce costs.

A feature of the present invention is that the device used to close the flow opening in the wiper plug is an integral part of the plug assembly. A flapper gate secured to the plug body is automatically closed when the plug leaves the mandrel. During the pumping circulation phases of the cementing operation, the flapper gate and seat, which may be made of easily eroded material, are protected behind the release sleeve and mandrel preventing erosion of the sealing surfaces. By contrast, the seals in the retrievable parts of the running tool that are exposed to the pumped fluids in the system of the invention are constructed of a high-strength, erosion resistant material, such as high-strength steel.

Another important feature of the present invention is that substantially the entire cross-sectional seal area of the wiper plug is exposed to differential pressure during the pressure induced deployment of the plug from its supporting mandrel. Systems that apply a pressure differential over a more limited area produce a smaller separation force. The mounting of the wiper plugs to the mandrel is such that application of deployment pressure to the bottom plug does not stress the bypass provision for other higher plugs in the assembly.

A further feature of the present invention is that, in addition to protecting the seals and other vulnerable components of the wiper plugs, the thin-walled, high-strength, retrievable mandrel tube of the invention permits the use of plugs having a large central flow passage with a relatively small outside diameter for effective use in smaller casing sizes.

From the foregoing, it will be appreciated that an important object of the present invention is to provide cementing plugs that are run from a thin-walled, high-strength tubular mandrel and release structure that permits large bypass flow openings through the plugs to permit increased flow rates and protect the plugs from erosion during the pumping process.

A related object of the present invention is to provide a retrievable, high-strength, thin-walled running tool constructed of a high-strength steel that permits the use of plugs that have a relatively small outside diameter and a relatively large bypass opening to permit high flow rates of cement slurry and drilling fluids.

Yet another object of the present invention is to provide a cement plug deployment system and apparatus in which two or more plugs contained within the system have substantially the same design to minimize the cost of construction of the system.

Another object of the present invention is to provide a remotely operable cement plug system that can be activated by either balls or darts to selectively and separately deploy two or more wiper plugs from a retrievable running tool.

It is also an important object of the present invention to provide a running tool mandrel and release mechanism constructed of a high-strength steel to provide a thin-walled retention and isolation structure for remotely running one or more cement wiper plugs wherein the mandrel and release mechanism are retrievable parts of the running tool.

Another important object of the present invention is to provide the remotely operated cementing plug assembly of the present invention within a combination fillup tool and cementing tool disposed above the drilling rig floor.

The foregoing features, objects and advantages of the invention, as well as others, will become more fully appreciated and better understood by reference to the following drawings, specification and claims.

DESCRIPTION OF THE ILLUSTRATED EMBODIMENTS

Figure 1:
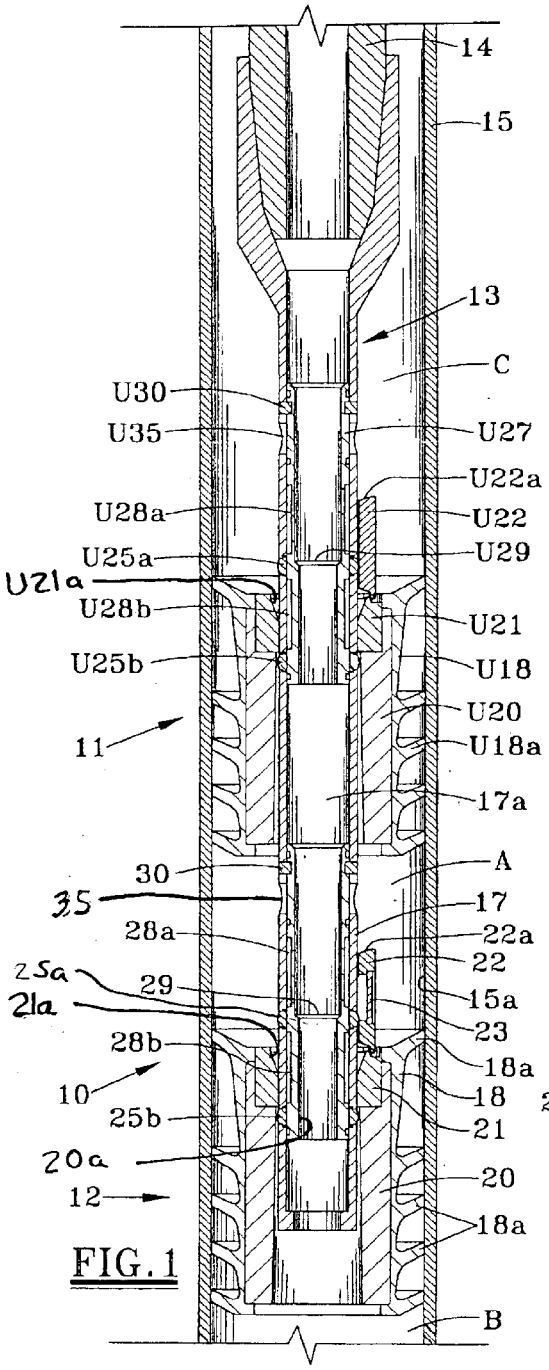
FIG. 1 is a longitudinal sectional view of a cement plug launching system illustrating a pair of cement plugs mounted on the lower end of a running tool mandrel.

A remotely releasable cement plug and running tool system of the present invention is indicated generally at 10 in FIG. 1. The system 10 includes an axially extending upper plug indicated generally at 11 and an axially extending lower plug indicated generally at 12. The two plugs 11 and 12 are carried on a running tool indicated generally at 13. The system 10 is suspended from the lower end of a drill string 14 that extends to the well surface (not illustrated). The system 10 is illustrated disposed within an axially extending well casing 15 that is to be cemented into a wellbore in a surrounding formation (not illustrated). The casing 15 is supported from a liner hanger (not illustrated) that is also carried by the drill string 14. The upper and lower plugs 11 and 12 are releasably secured to a retrievable axially extending tubular mandrel 17 that extends through the plugs and forms a major component of the running tool 13. A central flow passage 17*a* extends axially through the mandrel 17.

The plugs 11 and 12 are preferably constructed of synthetic materials that are easily drilled away or milled up during the subsequent deepening or completion of the well following the cementing operation. The lower plug 12 is constructed substantially in the form of an elastomeric cylindrical body having an axially extending, circumferential outer seal 18. The outer seal 18 includes a number of annular cup seals 18*a* that extend circumferentially about the central body of the seal 18 and operate to effect a sliding, sealing contact with an internal cylindrical surface 15*a* formed within the casing 15. The seal 18 may be constructed of rubber, or other suitable elastomeric material.

The outer seal 18 is mounted about a central tubular seal support 20. A flapper valve mount 21 is carried in the upper end of the seal support 20 for supporting a hinged flapper closure gate 22. The valve mount 21 encircles and forms a sliding inner seal with the mandrel 17.

Figure 1A:
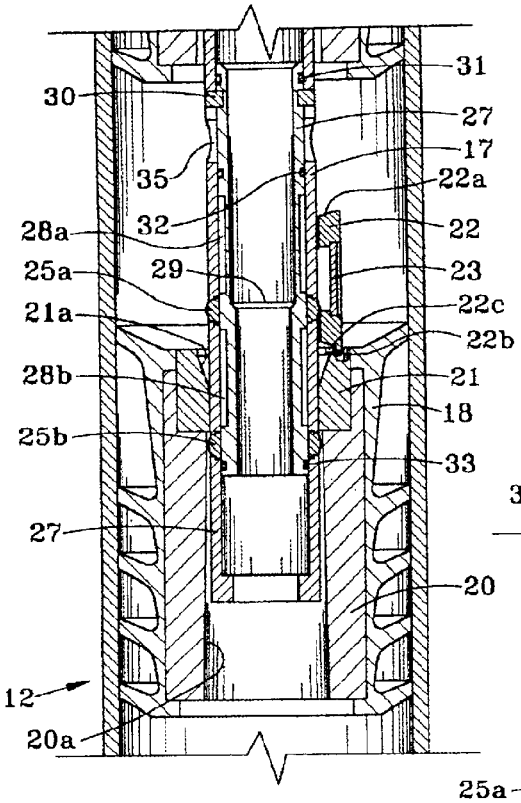
FIG. 1A is an enlarged view of a portion of FIG. 1 illustrating the bottom plug before downshifting of a release sleeve.
Figure 2A:
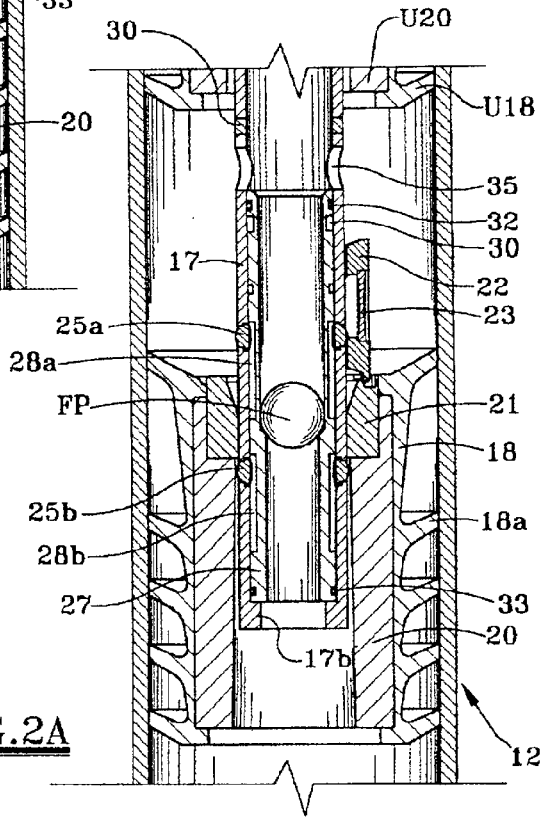
FIG. 2A is an enlarged view of a portion of FIG. 2 illustrating a bottom plug following downshifting of the release sleeve and before displacement of the plug from the running tool mandrel.

Referring jointly to FIGS. 1 and 1A, the flapper valve mount 21 is provided with a tapered, annular seating surface 21*a* that is designed to mate with and seal against a corresponding annular seal surface 22*a* formed along the external rim of the flapper gate 22. As will hereafter be explained in greater detail, the flapper gate 22 springs to a closed position sealing a central opening 20*a* through the plug 12 when the lower plug is ejected from the mandrel 17. A frangible disk 23 carried centrally on the flapper gate 22 functions as a releasable seal that is adapted to be ruptured after engaging with the float assembly (not illustrated) at the bottom of the casing string 15 to reestablish a flow passage through the plug 12.

The lower plug 12 is held to the mandrel 17 by radially movable upper and lower sets of dogs 25*a* and 25*b* that extend through radial openings in the wall of the mandrel 17. Serrated end faces on the radially external end faces of the dogs in the dog set 25*b* engage the internal surface of the opening 20*a* within the seal support 20, locking the lower plug 12 to the mandrel and temporarily preventing axial displacement between the mandrel and the plug. The dog sets 25*a* and 25*b* are held radially extended by a central moveable closure member or release sleeve 27 that engages the radially internal ends of the dogs. When in the position illustrated in FIGS. 1 and 1A, the sleeve 27 prevents the dogs in the dog set 25*b* from moving radially inwardly out of engagement with the seal support 20, thereby retaining the plug 12 on the mandrel.

The release sleeve 27 is equipped with external, reduced diameter sections 28*a* and 28*b* that permit release of the plug 12 when the sleeve is shifted axially downwardly. Down shifting of the sleeve 27 places the sections 28*a* and 28*b* in registry behind the radial ends of dog sets 25*a* and 25*b*, respectively, permitting the dog sets 25*a* and 25*b* to move radially inwardly, releasing the surrounding seal support 20 and associated plug 12.

The release sleeve 27 is initially secured temporarily to the surrounding mandrel 17 by shear pins 30. Annular, elastomeric O-ring seals 31, 32 and 33 are positioned about the sleeve 27 between the sleeve and the surrounding internal surface of the mandrel 17. The seal rings 31, 32 and 33 prevent leakage from the mandrel passage 17*a* through radial openings within the mandrel formed by the shear pins 30, dog sets 25*a* and 25*b* and large diameter radial ports 35 formed in the wall of the mandrel 17. As will also be described more fully hereinafter, downward shifting of the release sleeve 27 opens the large diameter radial ports 35 permitting flow from the mandrel into an annular pressure area A between axial ends of the plugs 11 and 12.

The flapper gate 22 is secured to the flapper valve mount 21 by a hinge pin 22*b*. A coil spring 22*c* biases the gate 22 from its opened position illustrated in FIG. 1A to a closed position illustrated in FIGS. 3 and 4. The coil spring may be constructed of any suitable material that provides the necessary biasing force to move the gate to its closed position. Because of its small size and volume, spring steel may be employed for the spring 22*c* without significantly increasing the mill up time required to remove the wiper plug 12 at completion of the cementing operation.

A central annular flow plug seat 29 is provided within the release sleeve 27. As will hereinafter be described more fully, the seat 29 cooperates with a ball or dart inserted into and pumped down the drill string 14 from the surface to form a pressure responsive mechanism to effect the downward shift of the sleeve 27.

The upper plug 11 design is substantially equivalent to the lower plug 12 with the major distinction being that the flapper closure gate of the lower plug is equipped with a frangible disk that is not provided in the upper plug 11. The various components of the upper plug 11 have been identified with reference characters that are the same as those employed in the identification of corresponding elements of the lower plug 12 with the exception of the addition of the letter "U" for the reference characters referring to the upper plug 11. Thus, components 18, 18*a*, 20 and 21 in the lower plug 12 correspond to the components U18, U18*a*, U20 and U21, respectively in the upper plug 11. As will hereinafter be explained in greater detail, because the lower plug is first to be launched, the central opening through the upper plug 11 is greater than that of the lower plug 12.

In the operation of the remotely releasable cement plug assembly and running tool assembly of the system 10, the combined assembly is lowered axially into a well until it is positioned at the top of the casing string to be cemented into the wellbore, a position indicated in FIG. 1. At this initial time in the method, the well casing 15 is typically filled with a drilling fluid, or mud, that is employed, in part, to maintain pressure control over the well.

The cementing operation is initiated by inserting a flow plug in the form of a ball FP into the drill string 14 at the well surface and pumping a cement slurry behind the plug to force the ball to move downwardly through the drill string ahead of the cement and into the system 10 where it seats on the flow plug seat 29 of the lower plug 12. The dimensions of the ball FP are selected so that it will pass freely through the upper flow plug seat U29 and engage the seat 29 within the smaller diameter opening associated with the lower cement plug 12. It will be appreciated that during the pumping of fluids occurring with the assembly 10 in the position illustrated in FIG. 1, the flapper gate sealing surfaces U22*a* and 22*a* and the seats U21*a* and 21*a* are protected from the erosive effects of the flowing fluids by the mandrel 13 and release sleeves U27 and 27. The seats U29 and 29 that are exposed to the flowing fluids are formed in the high-strength steel of the release sleeve and are resistant to erosion.

Figure 2:
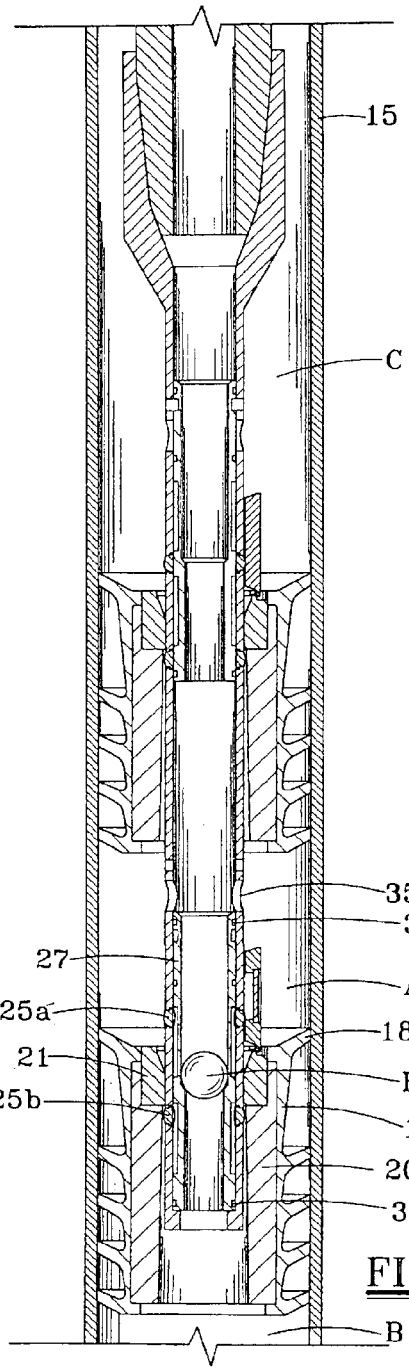
FIG. 2 is a longitudinal sectional view similar to FIG. 1 illustrating a bottom internal sleeve shifted downwardly prior to displacing a bottom plug from the system.

Once the ball FP has seated on the seat 29, a closure mechanism is created such that continued pumping of fluid creates a pressure differential between the fluid in the tool 13 upstream of the ball and that downstream of the ball. When the pressure differential is sufficiently great, the pressure induced force acting on the sleeve 27 through the ball FP operates as a release mechanism that shears pins 30 and releases the sleeve from its engagement with the mandrel 17. The O-ring seals surrounding the sleeve maintain a seal with the wall 20*a* of the seal support and continued application of the pressure differential across the ball and seat seal shifts the sleeve 27 downwardly into the position illustrated in FIG. 2.

At the end of the downshifted position, the sleeve 27 is prevented from continued downward movement within the mandrel 17 by a lip 17*b* formed along the base of the mandrel. In this lower position, the dog sets 25*a* and 25*b* function as a release mechanism freed to move radially inwardly, which releases the lower plug 12 from engagement with the mandrel 17. Shifting the sleeve 27 also opens the radial ports 35 and permits the pressurized cement slurry to flow into the annulus area A.

Continued pumping from the surface pressurizes the fluid in the annular area A located between the axial ends of the upper and lower plugs 11 and 12 and between the casing 15 and the mandrel 17. In the configuration illustrated in FIG. 2, the casing 15 is sealed by the combined operation of the outer seal 18, the seal support 20, the sleeve 27, the flapper valve mount 21, the ball FP, the mandrel 17 and the seal ring 33.

Figure 3:
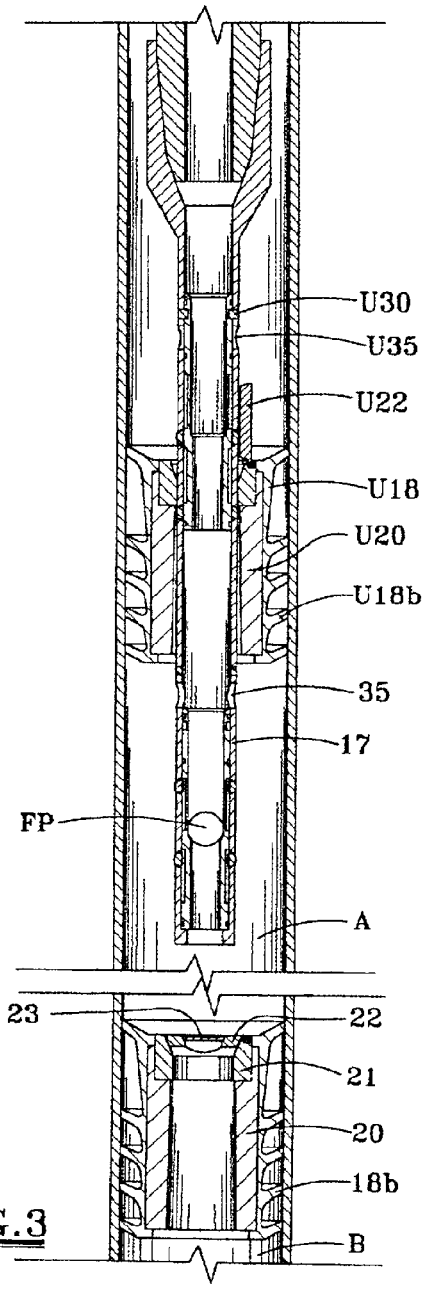
FIG. 3 is a longitudinal sectional view of a launching system of the present invention illustrating a bottom plug deployed from a running tool mandrel.

When the pressure in the area A becomes sufficiently greater than that in a pressure area B below the plug 12, the plug 12 is moved axially along the mandrel 17 and pushed off of the mandrel 17 into a position such as illustrated in FIG. 3. Once the plug 12 clears the mandrel, the spring loaded flapper closure gate 22 is free to snap closed and seal the central opening through the plug. The closed flapper gate functions as a one-way valve that prevents fluid flow from the pressure area A to the pressure area B. The application of pressure to the cement slurry in the area A causes the plug to advance downwardly through the casing 15. During this procedure, the ball FP and sleeve 27 are retained within the mandrel 17 as the cement slurry flows into the casing 15.

The cement slurry driving the wiper plug 12 downwardly is pumped into the casing until a calculated amount of the cement, sufficient to adequately cement the casing into the wellbore, has been introduced into the drill pipe and casing. A second flow plug in the form of a ball UFP is then introduced into the drill string at the well surface and drilling fluid is pumped down the drill string behind the ball to move the ball through the drill pipe to the running tool.

The diameter of the second ball UFP is larger than that of the first ball FP and is larger than the diameter of the seat U29 so that the ball lands upon and seats within the seat U29. The application of sufficient pressure in the tool 13 above the ball UFP causes the shear pins U30 to shear permitting the sleeve U27 to shift downwardly into the position illustrated in FIG. 4. The downward movement of the sleeve U27 is stopped when it engages the top of the lower sleeve 27.

Figure 4:
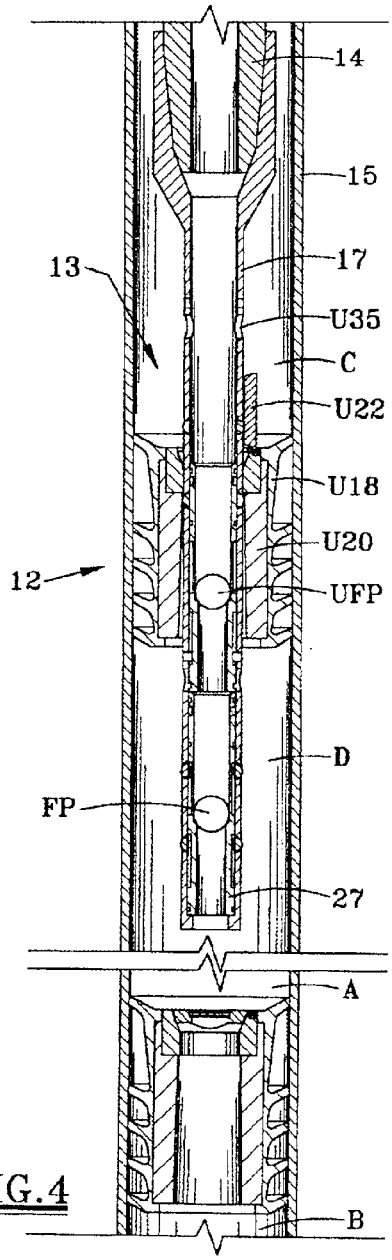
FIG. 4 is a longitudinal sectional view similar to FIG. 3 illustrating a top internal sleeve shifted downwardly prior to releasing a top plug.

In the position illustrated in FIG. 4, the reduced diameter areas U28*a* and U28*b* register with the internal radial ends of the dog sets U25*a* and U25*b*, respectively, permitting the dogs to retract radially which in turn frees the upper plug 12 from the mandrel 17. Shifting the sleeve U27 downwardly also opens the large bore radial ports U35 so that the pressure being applied through the drill pipe 14 is applied into an annular area C intermediate the mandrel 17 and the surrounding casing 15 and above the plug 12.

Figure 5:
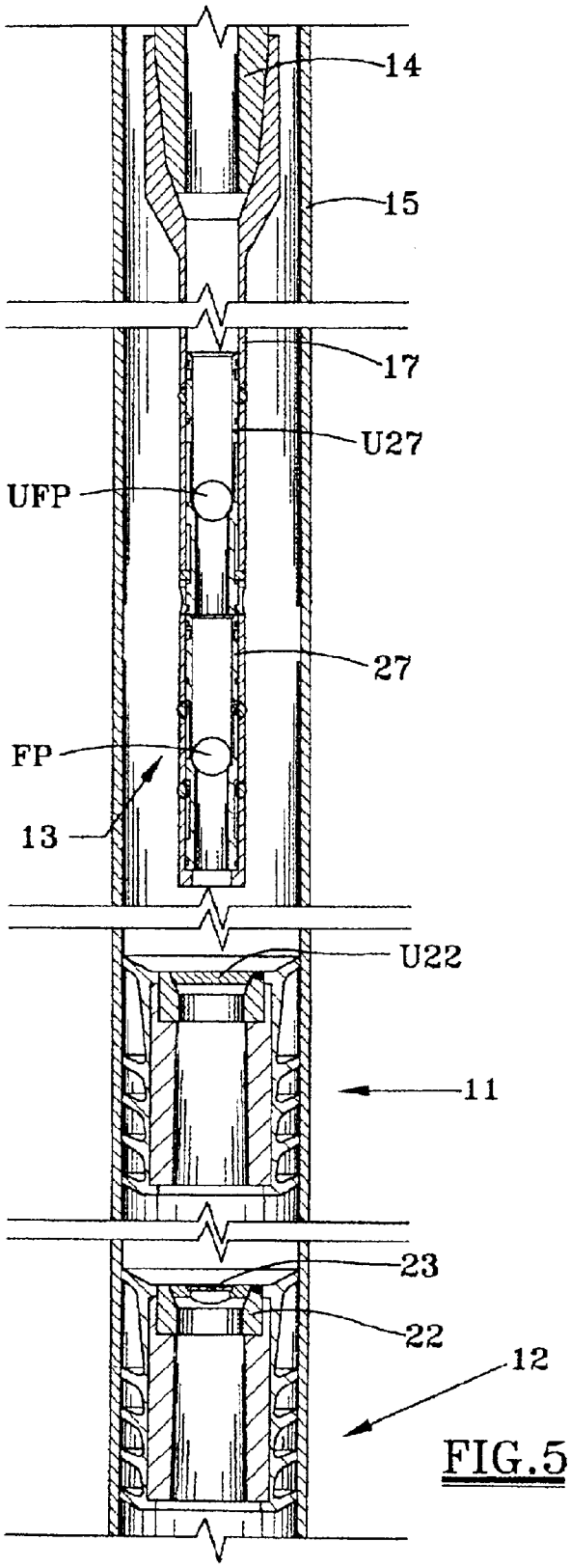
FIG. 5 is a longitudinal sectional view similar to FIG. 3 illustrating the running tool mandrel after release of both plugs.

As with the lower plug 11, the upper plug 12 cooperates with the mandrel 17, the release sleeve 27 and the flow plug ball UFP to isolate the higher pressure in the area C from an area of lower pressure D below the plug 12. The pressure differential between the area C and the area D causes the plug 12 to move downwardly over the mandrel 17 until it is free of the mandrel as indicated in FIG. 5. Once the plug 12 has cleared the mandrel, the spring-loaded flapper valve U22 snaps closed so that the plug 12 again effectively seals the areas C and D from each other. The continued application of pressure above the plug 12 in the area C forces the plug to move downwardly through the casing 15, moving the cement slurry contained between the plugs 11 and 12. During this procedure, the ball UFP and sleeve U27 are retained within the mandrel 17 as the drilling fluid flows into the casing.

When the bottom plug 12 engages and seals the bottom of the casing string 15, the pressure of the cement slurry in the casing ruptures the disk 23. Cement is then forced through the plug 12 via the opening created by the rupture of the disk 23 whereupon the cement exits the bottom (not illustrated) of the casing and returns back toward the well surface in the annulus between the casing and the surrounding wellbore in a manner well known in cementing procedures. Cement continues to be displaced ahead of the moving upper plug 11 until the upper plug 11 engages and stops against the top of the lower plug 12.

The running tool 13, as indicated in FIG. 5, remains connected to the drill string 14 during the cementing process and can be retrieved to the surface with the withdrawal of the drill string. The major components of the running tool 13 may be fabricated from high-strength, thin walled steel and other high-strength materials that would be difficult to drill out had they been a part of the assemblies pumped downhole. The mandrel 17, balls FP and UFP and sleeves 27 and U27 may be retrieved, cleaned, redressed and run again in another cementing operation.

Figure 6:
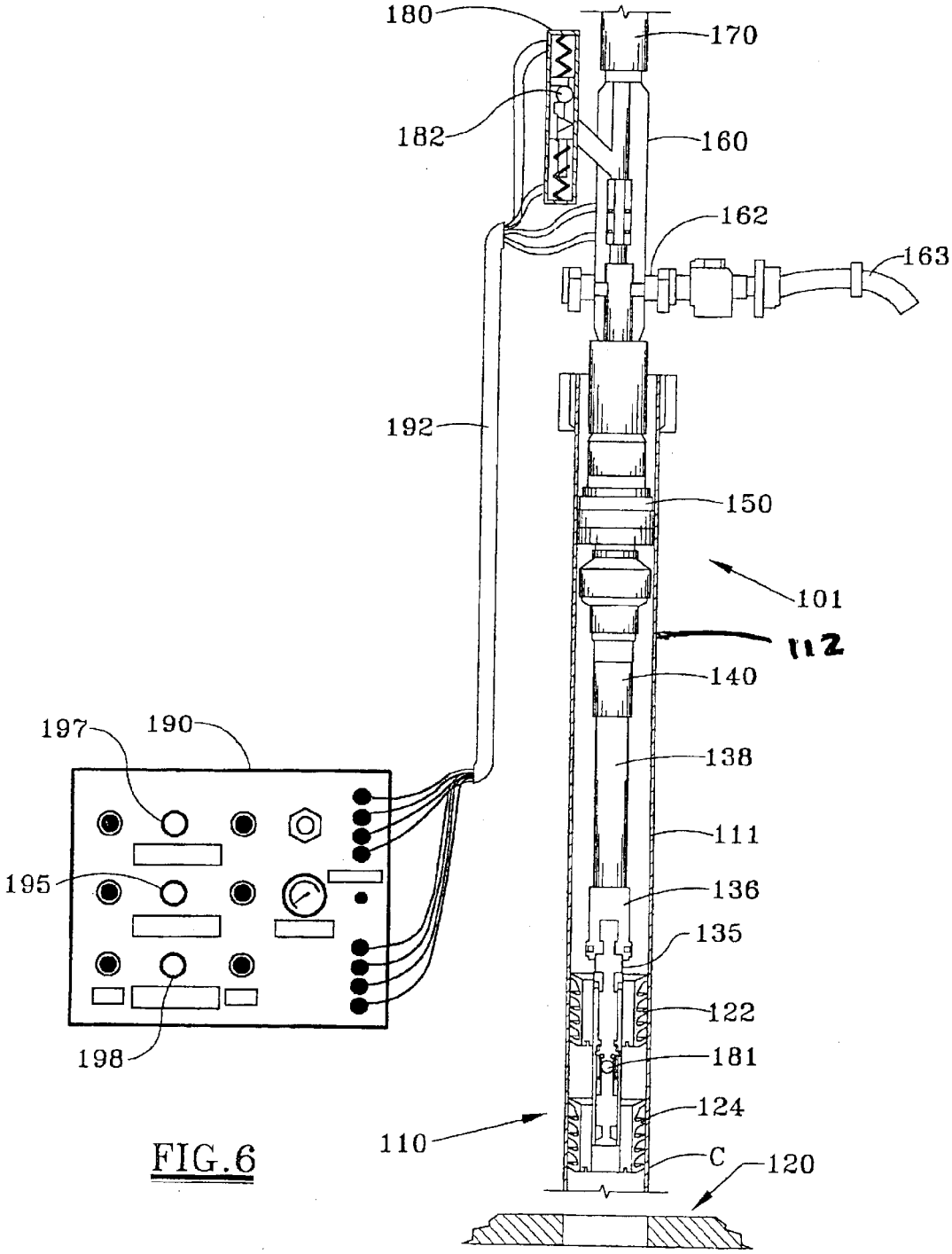
FIG. 6 is a vertical elevation, partially in section, illustrating a combination fillup tool and cementing tool assembly equipped with a remotely set wiper plug launching system of the present invention.

FIG. 6 of the drawings illustrates a combination tool indicated generally at 101 comprising a fillup tool combined with a cementing assembly. The combination tool 101 is equipped with a remotely set cementing plug assembly of the present invention, indicated generally at 110. The combination tool 101 supports the cementing plug assembly 110 of the present invention within the top joint 111 of a casing string 112. The casing string 112 extends through a drilling rig floor 120 into the well bore (not illustrated). The cementing plug assembly 110 is a dual plug assembly comprised of an upper plug 122 and a lower plug 124. The assembly 110 is constructed and operated substantially the same as the assembly 10 described in FIGS. 1–5.

The combination tool 101 carries the cementing plug assembly 110 on a setting tool 135 secured to the lower end of the combination tool. The upper end of the assembly 110 is connected to supply lines that provide drilling fluid and a cement slurry to be pumped into the casing 112 through the combination tool 101. The combination tool 101 includes a lower equalizing valve 136 connected to a mandrel 138 which in turn connects to an upper equalizing valve 140. The valve 140 connects to a packer cup assembly 150 that provides a seal between the inside of the casing joint 111 and the combination tool 101.

The upper end of the packer cup assembly 150 connects with a cementing manifold 160 through which a cement slurry and drilling fluids may be selectively introduced into the casing 112. A cement port connection 162 provides access into the manifold 160 for a cement slurry introduced through a supply line 163. The upper end of the manifold 160 is connected to a top drive adapter or hook adapter 170 through which drilling fluids may be pumped through the combination tool 101 into the casing 112.

A ball drop injection assembly 180 communicates through the cementing manifold 160 for selectively inserting setting balls into the manifold as required to remotely launch the cementing plugs 122 and 124 from the running tool 135. In the embodiment of FIG. 6, the ball injection assembly 180 is designed to hold two setting balls, a smaller ball 181 and a larger ball 182. FIG. 6 illustrates the larger setting ball 182 in place within the injection assembly 180. The smaller setting ball 181 is illustrated in FIG. 6 in sealing position with the lower cementing plug 124 after having been injected into the combination tool 101 from the assembly 180.

A remote control assembly 190 remotely controls the release of balls within the ball drop injection assembly 180 via electrical signals and fluid pressure applied through control lines 192. Control buttons 195, 197 and 198 on the control consoles are used to remotely control the launching of the wiper plugs and the closing of the central flow opening through the combination tool 101

In the operation of the embodiment of the invention illustrated in FIG. 6, a mud saver valve (not illustrated) used during the placement of the major length of the casing string into the well bore is removed from the fillup tool 101 and replaced with the dual plug assembly 110. The combination tool 101 with the plug assembly 110 attached is then lowered into the top of the casing string joint 111. As when operating as a fillup tool, the packer cup portion of the tool 101 provides a fluid seal between the tool 101 and the casing to prevent the escape of fluids being pumped into the casing.

In the configuration illustrated in FIG. 6, with the plug assembly 110 attached to the bottom of the combination tool, and with both balls contained within the injection assembly 180, drilling fluids may be pumped into and circulated through the combination tool and casing string and additional joints of casing may be added to the string as required to reach the desired setting depth for the casing string. When the casing string reaches the desired setting depth, and after properly conditioning the well bore by circulating drilling fluids, the bottom cementing plug is remotely released from the remote console 190 by manually depressing the bottom release button 195.

Depressing the button 195 effects the injection of the ball 181, which is the smaller of two setting balls contained within the ball drop head assembly 180, into the cementing manifold 160. Following release of the smaller ball into the cementing manifold, a cement slurry is pumped into the manifold through the cement port connection 162. The cement slurry and gravity move the ball 181 into the seated position within the lower plug 124 as illustrated in FIG. 6. The setting ball 181 seals the running tool flow passage and causes the lower plug to launch into the casing string in the manner previously described with reference to the embodiments illustrated in FIGS. 1 through 5.

Once sufficient cement has been pumped into the casing string 112, the button 197 of the remote control console 190 is depressed to inject the larger setting ball 182 from the ball drop injection assembly 180 into the manifold 160. Pumping of cement is then terminated and drilling fluid is pumped into the combination tool 101 through the adapter 170. Gravity and the drilling fluid move the ball 182 into sealing engagement within the running tool mandrel in the upper cementing plug 122. The upper cementing plug 122 is launched from the running tool 135 to displace the cement in the casing and wipe the inside of the casing wall, substantially as described previously with respect to the embodiment-of FIGS. 1–5. Subsequent operation of the cementing process is substantially as described previously with respect to the embodiment of FIGS. 1–5.

The design of the present invention permits substantially larger flow openings to be formed through remotely set, multiplug cementing assemblies. A conventional remotely released multiplug assembly of the prior art will have a minimum central opening available for the passage of the cement slurry and the drilling fluids of as small as 1.5 inches. In a two plug system of the present invention, the smallest internal diameter of the flow passage is 1.75 inches. If only a single plug is used, the smallest internal diameter is 2 inches and that of a prior art plug is 1.875 inches. Thus, it will be appreciated that the flow passage opening size possible with the running tool and dual plug assembly of the present invention represents an increase of 17% over that of the prior art.

The following table illustrates the greater number of components and the larger component dimensions required in cementing tools of the prior art design as compared with the design of the present invention.

| | OD (inches) | ID (inches) |
|---|---|---|
| Prior Art Components | | |
| Collet Retainer (High-strength Steel) | 4.500 | 3.700 |
| Collet (aluminum) | 3.690 | 2.998 |
| Releasing sleeve (aluminum) | 2.990 | 1.875 |
| Connector (aluminum) | 2.560 | 1.875 |
| Ball Seat (aluminum) | 2.250 | 1.500 |
| Multi-plug Assembly of the Present Invention - All parts High-strength Steel - 110–125 ksi yield strength | | |
| Mandrel | 3.500 | 2.750 |
| #1 Releasing Sleeve | 2.742 | 2.000 |
| #2 Releasing Sleeve | 2.742 | 1.750 |

As may be noted from the table, the diameters of the central flow dimensions made available with the novel cementing assembly of the present invention have been increased by a factor of approximately 17%. Moreover, as compared with the plugs of the present invention, the volume of metal remaining with the prior art plugs traveling to the bottom of the casing string is substantially greater. It will also be appreciated that the reduced volume of metal in the plugs of the present invention allows the plugs to be more rapidly and easily milled up or drilled out as compared with those of the prior art.

While preferred embodiments of the present invention have been illustrated in detail, it is apparent that modifications and adaptations of the preferred embodiments will occur to those skilled in the art and such modifications and adaptations are within the spirit and scope of the present inventions as more completely set forth in the following claims.

What is claimed is:

1. A well tool for selectively sealing areas within a well tubular comprising:

a first axially extending plug adapted to be axially movable within an axially extending well tubular for isolating fluids in first and second areas within said well tubular on either axial end of said first plug, a first outer seal for providing a sliding, sealing engagement between said first plug and an internal surface of said well tubular, an axially extending mandrel extending through said first plug, a mandrel flow passage extending axially through said mandrel, a first inner seal for providing a sliding, sealing engagement between said first plug and said mandrel, a first port extending from said flow passage of said mandrel to said first area, a first movable closure member movable between a closed and an open position for respectively closing said first port when in said closed position or opening said first port when in said open position whereby said first closure member respectively blocks or permits pressure communications between said mandrel flow passage and said first area, a first closure mechanism for moving said first closure member from said closed to said open position, and a first release mechanism responsive to movement of said first closure mechanism for permitting said first plug to be displaced axially free of said mandrel in response to a pressure differential between said first area and said second area.

2. A well tool as defined in claim 1 further comprising:

a first one-way valve for sealing a central opening through said first plug when said first plug is displaced from said mandrel whereby said first plug forms a seal within said well tubular for isolating said first and second pressure areas.

3. A well tool as defined in claim 2 further comprising a releasable seal carried by said first plug, said releasable seal being selectively operable to provide pressure communication between said first and second areas.

4. A well tool as defined in claim 2 further comprising a second axially extending plug adapted to be axially movable within said well tubular for isolating fluids in third and fourth areas within said well tubular on either axial end of said second plug, said second plug disposed about said mandrel, a second outer seal for providing a sliding, sealing engagement between said second plug and an internal surface of said well tubular, a second inner seal for providing a sliding, sealing engagement between said second plug and said mandrel, a second port extending from said flow passage of said mandrel to said third area, a second movable closure member movable between a closed and an opened position for respectively closing said second part when in said closed position or opening said second port when in said open position whereby said second closure member respectively blocks or permits pressure communication between said mandrel flow passage and said third area, a second closure mechanism for moving said second closure member from said closed to said opened position, and a second release mechanism responsive to movement of said second closure mechanism for permitting said second plug to be displaced axially free of said mandrel in response to a pressure differential between said third area and said fourth area.

5. Well tool as defined in claim 4 further comprising:

a second one-way valve for sealing a central opening through said second plug when said second plug is displaced from said mandrel whereby said second plug forms a seal within said well tubular for isolating said third and fourth pressure areas.

6. A well tool as defined in claim 1 wherein, when displaced from said mandrel, said first plug is a body having a major percentage of its composition being a nonmetallic material.

7. A well tool as defined in claim 1 wherein said mandrel is retrievable through said well tubular following displacement of said first plug.

8. A well tool as defined in claim 1 wherein said first closure mechanism includes a first flow closure device that seals said mandrel flow passage to seal said first area from said second area whereby a pressure differential acting across said first closure mechanism moves said first release mechanism.

9. A well tool as defined in claim 8 wherein said first flow closure device comprises a ball.

10. A well tool as defined in claim 8 wherein said first flow closure device comprises a dart.

11. A well surface operated system for remotely deploying wiper plugs into a well casing comprising:

a running tool having an axially extending tubular mandrel, said mandrel having an axially extending flow passage for conducting fluid axially through said well casing, a first plug carried by said mandrel, said first plug having an outside sealing diameter for sealing with an internal surface of said well casing and further having an axially extending flow passage cooperating with said axially extending flow passage of said running tool for conducting fluids axially through said well casing, a first release mechanism carried by said mandrel, said first release mechanism being operable from a well surface with a release mechanism actuator to actuate said first release mechanism to release said first plug from said mandrel, and a first flow passage closure device, separate from said release mechanism actuator, carried by said first plug, said first flow passage closure device being operable when said first plug is released from said mandrel to seal said flow passage extending through said first plug whereby fluid conducted axially through said mandrel flow passage to said first plug from said well surface will move said first plug through said casing.

12. A remotely operated system as defined in claim 11 further comprising:

a second wiper plug carried by said mandrel, said second wiper plug having an outside sealing diameter for sealing with said internal surface of said well casing and further having an axially extending flow passage cooperating with said axially extending flow passage of said mandrel for conducting fluids axially through said well casing, a second release mechanism carried by said mandrel, said second release mechanism being operable from the well surface with a second release mechanism actuator to actuate said second release mechanism to release said second plug from said mandrel, and a second flow passage closure device, separate from said second release mechanism actuator, carried by said second plug, said second flow passage closure device being operable when said second plug is released from said mandrel to seal said flow passage extending through said second plug.

13. A remotely operated system as defined in claim 12 wherein said mandrel and said release mechanisms and said release mechanism actuators are retrievable to the well surface with said running tool after said first and second plugs are released from said mandrel.

14. A remotely operated system as defined in claim 13 wherein said flow passage closure devices comprise flapper gates carried by said first and second plugs.

15. A remotely operated system as defined in claim 14 wherein said wiper plugs are provided with sealing surfaces on passage closure devices that meet to close the flow passages through said plugs when said plugs are released from said mandrel, and wherein said sealing surfaces are protected from erosion caused by fluids flowing through said well casing before said plugs are released from said mandrel.

16. A remotely operated system as defined in claim 15 wherein said release mechanisms comprise axially extending sleeves carried coaxially within said running tool and wherein said sleeves are movable axially by said release mechanisms to release said plugs from said mandrel.

17. A remotely operated system as defined in claim 16 wherein said release mechanisms comprise sleeves coaxially carried by said mandrel and said release mechanism actuators comprise balls or darts introduced into said running tool from said well surface whereby said actuators engage and seal with said sleeves and whereby pressure applied from the well surface through said running tool shifts said sleeves axially to release said plugs from said mandrel and to open a lateral flow passages through said mandrel communicating said mandrel flow passage with areas in said well casing between said well surface and said plugs.

18. A remotely operated system as defined in claim 12 wherein said plugs are respectively provided with sealing surfaces on passage closure devices that meet to respectively close the flow passages through said plugs when said plugs are released from said mandrel, and wherein said sealing surfaces are protected from erosion caused by fluids flowing through said well casing before said plugs are released from said mandrel.

19. A remotely operated system as defined in claim 11 wherein said mandrel and said release mechanism and said release mechanism actuator are retrievable to the well surface with said running tool after said first plug is released from said mandrel.

20. A remotely operated system as defined in claim 11 wherein said flow passage closure device comprises a flapper valve gate carried by said first plug.

21. A remotely operated system as defined in claim 11 wherein, said first plug includes a sealing surface seat extending about said first plug flow passage and said first flow passage closure device includes a first sealing component adapted to engage and seal with said first sealing surface seat to close said wiper plug flow passage, and wherein said first sealing surface seat and said first sealing component are protected from erosion when said first plug is carried by said mandrel.

22. A remotely operated system as defined in claim 11 wherein said first release mechanism comprises an axially extending sleeve carried coaxially within said running tool and wherein said sleeve is movable axially by said release mechanism to release said plug from said mandrel.

23. A remotely operated system as defined in claim 11 wherein said first release mechanism and said release mechanism actuator cooperate with said running tool to isolate a first area in said well casing on one axial end of said first plug from a second area in said well casing at a second axial end of said first plug whereby pressure applied at said first axial end is effective on said first plug across a cross-sectional area substantially equal to the cross-sectional area of said first plug for producing a pressure induced axial force tending to move said first plug axially through said well casing when said first plug is mounted on said mandrel.

24. A remotely operated system as defined in claim 23 wherein said release mechanism comprises a sleeve coaxially carried by said mandrel and said release mechanism actuator comprises a ball or dart introduced into said running tool from said well surface whereby said actuator engages and seals with said sleeve and whereby pressure applied from the well surface through said running tool shifts said sleeve axially to release said first plug and to open a lateral flow passage through said mandrel communicating said mandrel flow passage with said first area in said well casing.

25. A remotely operated system as defined in claim 11 further comprising multiple plugs having substantially similar dimensions carried on said mandrel and adapted to be sequentially released from said mandrel.

26. A remotely operated system as defined in claim 25 wherein at least one of said plugs includes a flow passage reopening device for reopening the flow passage through said one plug after said one plug is released from said mandrel.

27. A remotely operated system as defined in claim 25 wherein release of one of said multiple plugs from said mandrel is effected without the application of release forces to another of said multiple plugs on said mandrel.

28. A remotely operated system as defined in claim 11 wherein said wiper plug is constructed substantially from non-metallic components.

29. A remotely operated system as defined in claim 11 wherein said running tool has sufficient axial development to receive a release mechanism activator comprising a ball or a dart.

30. A method for releasing plugs in a well casing for cementing said well casing in a wellbore comprising:

locking multiple plugs on a tubular mandrel of a running tool carried at the end of a well conduit, positioning said running tool and plugs within said well casing, flowing fluid through said well conduit and through said mandrel and plugs into said casing below said running tool, inserting a release actuator mechanism into said well conduit at the well surface, engaging said release actuator with an axially movable sleeve carried by said running tool, applying fluid pressure from the well surface to said release actuator to move said sleeve axially through said running tool for opening a flow passage from said mandrel into said casing and unlocking one of said wiper plugs from said mandrel, and applying fluid pressure across an area substantially equal to the full lateral cross-sectional area of said unlocked plug to produce a pressure induced force to move said unlocked plug axially for release from said mandrel.

31. A method as defined in claim 30 further comprising closing a flow passage through said unlocked plug after release from said mandrel whereby said plug seals said casing permitting said plug to be moved axially through said casing by fluid pressure applied from the well surface.

32. A method as defined in claim 31 further including protecting plug sealing surfaces formed on said plugs from erosion as fluid flows through said running tool.

33. A method as defined in claim 32 further comprising closing a flow passage through at least one of said plugs with a hinged flapper gate carried on said at least one wiper plug.

34. A method as defined in claim 33 further comprising constructing substantially of non-metallic materials.

35. A method as defined in claim 30 wherein said running tool, tubular mandrel and release actuator are retrieved to the well surface after said wiper plug are unlocked and released from said mandrel.

36. An apparatus for deploying plugs used in cementing a casing string from a well surface comprising:

a running tool adapted to be connected to the end of a tubular well pipe;

a thin wall, tubular mandrel in said running tool, said mandrel having a central flow passage extending axially through said mandrel and first and second flow passages extending laterally through said mandrel wall into said casing string, first and second plugs having first and second central flow passages, respectively, coaxially mounted on said tubular mandrel, first and second release sleeves coaxially mounted with said tubular mandrel for temporarily locking said first and second plugs, respectively, to said mandrel and for temporarily sealing, respectively, said first and second lateral flow passages, and first and second sealing members carried on said first and second plugs, respectively, for sealing said first and second central flow passages, respectively, when said plugs are released from said mandrel.

37. An apparatus as defined in claim 36 wherein said first and second sealing members are disposed intermediate said tubular mandrel and said casing while said plugs are locked on said mandrel for protecting said first and second sealing members from erosion caused by flow of fluids through said setting tool.

38. An apparatus as defined in claim 36 wherein said plugs are constructed substantially of non-metallic components.

39. An apparatus as defined in claim 36 wherein said mandrel and release sleeves are secured to and said running tool for retrieval to the surface after said plugs are released from said mandrel.

40. An apparatus as defined in claim 36 wherein said first and second release sleeves include internal pass-through openings and said pass-through opening of said first release sleeve is larger than said pass-through opening of said second release sleeve.

* * * * *